United States Patent [19]

Hall et al.

[11] 4,248,118

[45] Feb. 3, 1981

[54] HARMONY RECOGNITION TECHNIQUE APPLICATION

[75] Inventors: George R. Hall, Sherman Oaks; Robert J. Hall, Chatsworth, both of Calif.

[73] Assignee: Norlin Industries, Inc., Deerfield, Ill.

[21] Appl. No.: 3,586

[22] Filed: Jan. 15, 1979

[51] Int. Cl.[3] ..... G10H 1/38; G10H 5/00

[52] U.S. Cl. ..... 84/1.01; 84/DIG. 22

[58] Field of Search ..... 84/1.01, 1.03, 1.17, 84/1.24, DIG. 22

[56] References Cited

U.S. PATENT DOCUMENTS

| | | | |
|---|---|---|---|
| 3,725,560 | 4/1973 | Robinson et al. | 84/1.01 |
| 3,844,192 | 10/1974 | Brand et al. | 84/1.01 |
| 3,872,765 | 3/1975 | Amaya | 84/1.01 |
| 3,889,568 | 6/1975 | Amaya | 84/1.01 |
| 4,065,993 | 1/1978 | Hirose | 84/1.03 |
| 4,138,918 | 2/1979 | Kato | 84/1.03 |
| 4,142,433 | 3/1979 | Gross | 84/1.03 |
| 4,148,241 | 4/1979 | Morez et al. | 84/1.03 |

*Primary Examiner*—Stanley J. Witkowski

*Attorney, Agent, or Firm*—Allegretti, Newitt, Witcoff & McAndrews

[57] ABSTRACT

Techniques for translating the harmony expressed by the keyboard playing of a performer into a chord type and root. Playing key pattern representations are stored in a digital memory at locations having addresses defining the corresponding chord type. A playing key pattern signal identifying the pattern of the keys played by the performer is then generated. The playing key pattern signal is used to locate the corresponding stored playing key pattern representation. When a match occurs, the chord type and root are derived by a processor.

2 Claims, 6 Drawing Figures

ELECTRONIC ORGAN CIRCUITRY
OSCILLATOR
HARMONIC SPECTRUM ADJUSTER
MODULATOR
ENVELOPE GENERATOR
TEMPO
BOSSA NOVA
BIG BAND
BARO QUE
JAZZ GUITAR
CONTEMPORARY GUITAR & CELLI
GENERAL PURPOSE RAM
PROGRAM ROM
ORCHESTRATION & INSTRUMENT ROM
MICRO-PROCESSOR
LATCH
COUPLING NETWORK

HARMONY RECOGNITION TECHNIQUE APPLICATION

BACKGROUND AND SUMMARY OF THE INVENTION

This invention relates to electronic musical instruments, and more particularly relates to such instruments in which a keyboard is used by a performer to establish a desired harmony.

Electronic musical instruments, such as keyboard-controlled electronic organs, have experienced wide acceptance among muscians. Since many of these instruments are sold to amateurs, manufacturers place special emphasis on the ease of playing. In particular, the electronic musical instrument industry has long sought a method of deriving the chord type and root desired by a performer from his manipulation of the keyboard.

Past attempts in this direction have met with only limited success. For example, some instruments, such as a chord organ, require the performer to press a separate key for each chord type or root he desires. Although this device is a step in the right direction, it is cumbersome to a musician who normally defines the harmony desired by playing on a keyboard.

Accordingly, it is a principal object of the present invention to derive the harmony desired by a performer from his manipulation of a standard keyboard.

Another object is to facilitate a technique of the foregoing type in which the harmony is defined in terms of a chord type and root.

Yet another object is to provide a technique of the foregoing type which can be implemented by a microprocessor having only an eight bit data bus.

Still another object is to provide a technique of the foregoing type in which a minimum of processing time and digital memory is required.

DESCRIPTION OF THE DRAWINGS

These and other objects, advantages and features of the present invention will appear for purposes of illustration, but not of limitation, in connection with accompanying drawings wherein like numbers refer to like parts throughout and wherein.

DESCRIPTION OF THE PREFERRED EMBODIMENTS

Figure 1:
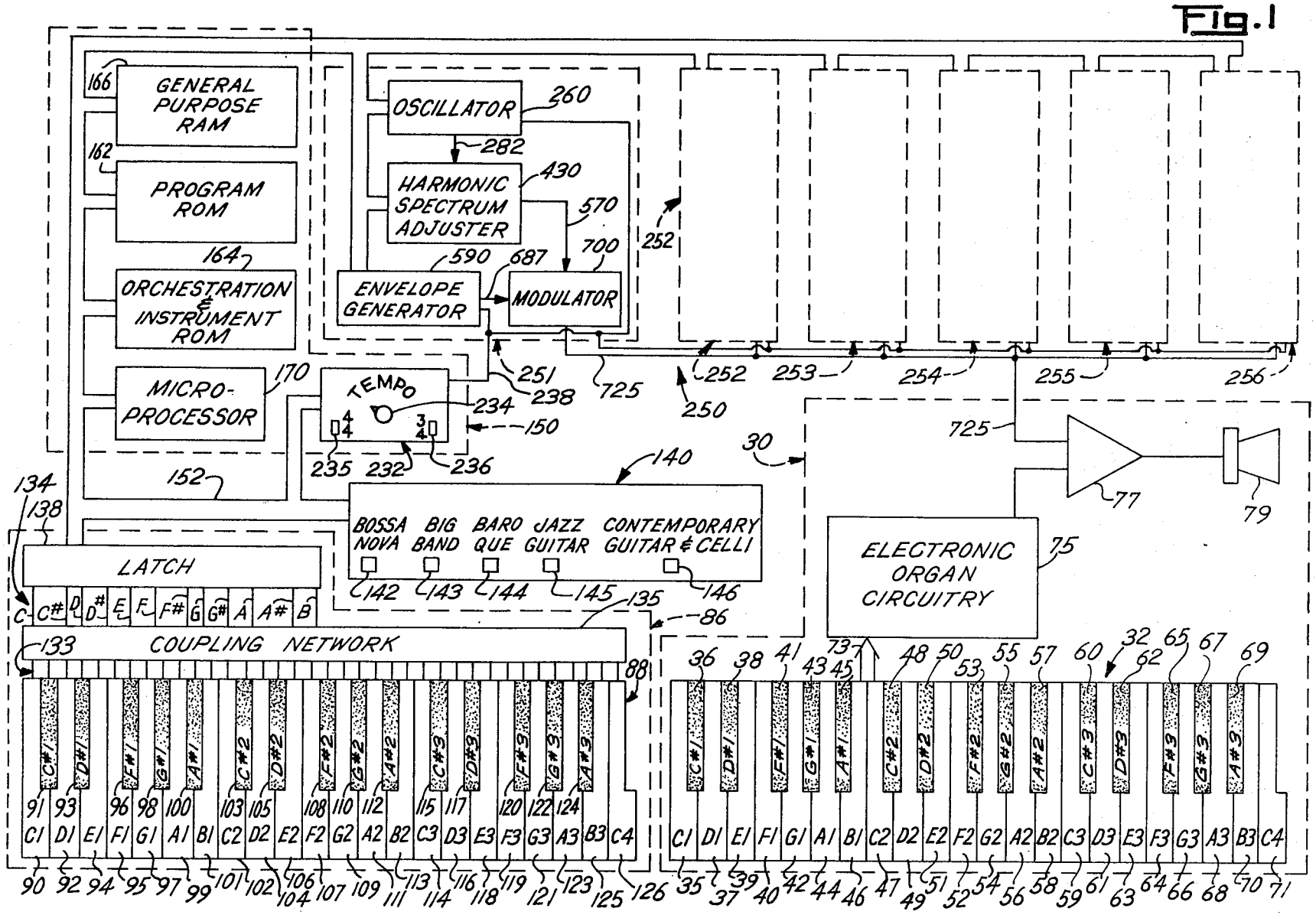
FIG. 1 is a logical block diagram of a preferred form of musical instrument in which the present invention can be employed.

The preferred embodiments of the present invention can be advantageously used in connection with an electronic musical instrument capable of providing a full orchestral accompaniment to a melody played in any one of the 12 possible harmonic keys. A block diagram of such an instrument is shown in FIG. 1. The instrument is more specifically described in the copending application of the present inventors and Jack C. Cookerly entitled "Orchestral Accompaniment Techniques", U.S. patent application Ser. No. 3,584, filed Jan. 15, 1979 which is incorporated by reference.

Basically the performer plays a melody with his right hand on a melody keyboard, and indicates a desired harmony by playing with his left hand on a harmony keyboard. The instrument automatically generates a full accompaniment based on the harmony selected by the left hand of the performer on the harmony keyboard. However, before the accompaniment can be generated by the instrument, the chord type and root selected by the performer's manipulation of the harmony keyboard must be ascertained. The chord types recognized by the instrument are major, minor, diminished, augmented and seventh, and the root note can be any of the twelve notes of the musical chromatic scale.

Referring to FIG. 1, a preferred form of electronic musical instrument suitable for use in connection with the present invention basically comprises a melody system 30, a musical style selector 140, a processing system 150 and an output system 250. As shown in FIG. 1, melody system 30 includes a conventional melody keyboard 32 which comprises playing keys 35–71. Each of the keys represents at least one note which is pitched in at least one octave. Keyboard 32 is connected through a cable 73 to conventional electronic organ circuitry 75. The circuitry produces audio tone signals based on the melody keys depressed by the performer in a well-known manner. The tone signals are transmitted through an output amplifier 77 to a conventional loudspeaker transducer 79 which converts the signals to sound.

Musical style selector 140 comprises switches 142–146 by which a performer can select any one of 5 musical styles. In response to the depression of one of switches 142–146, an eight bit word corresponding to the desired style is stored in a conventional eight bit register contained within selector 140. The word is read by processing system 150 and is used in a manner described in the above-identified copending application.

Figure 2:
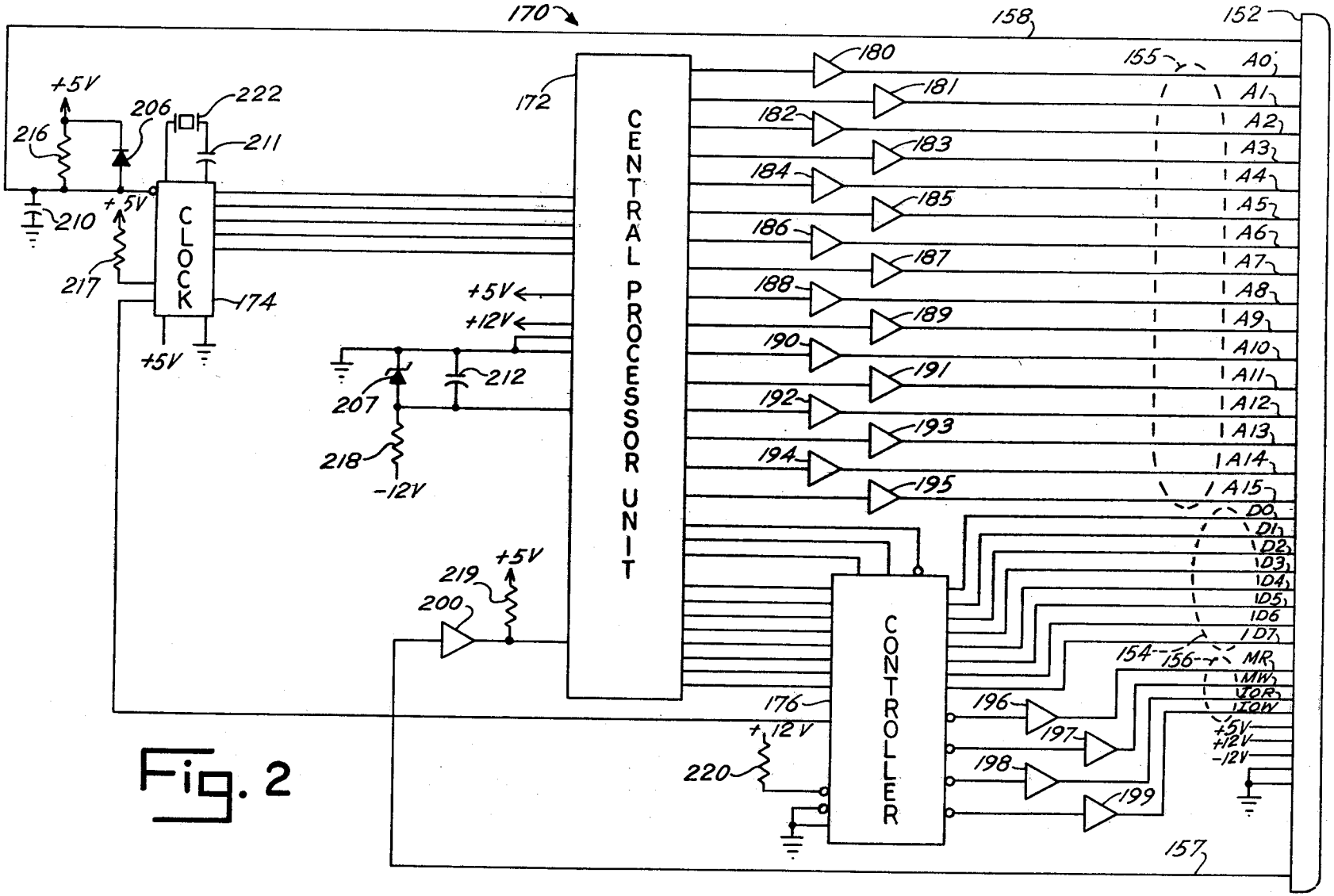
FIG. 2 is an electrical schematic diagram of a preferred form of microprocessor used in connection with the musical instrument shown in FIG. 1.

Referring to FIGS. 1 and 2, processing system 150 comprises a communication bus 152 that is subdivided into an eight bit data bus 154, a sixteen bit address bus 155, a four bit read-write bus 156, an interrupt line 157 and a clock line 158.

The processing system also includes a program read only memory (ROM) 162 which stores instructions for the overall system. An orchestration and instrument ROM 164 stores digital information necessary for the production of the musical segments which make up the accompaniment. A general purpose random access memory (RAM) 166 is used to hold intermediate variables and working data pointers used by a miroprocessor 170 which performs sequential programmed logic functions in order to operate the system.

Referring to FIG. 2, microprocessor 170 comprises a central processor unit 172 which may be a general purpose microcomputer, such as model 8080 manufactured by Intel Corporation. The microprocessor also includes a processor clock 174 which may be a model 8224 manufactured by Intel Corporation, and a system controller 176 which may be a model 8228 manufactured by Intel Corporation. The microprocessor also includes amplifiers 180–200, diodes 206–207, capacitors 210–212, resistors 216–220, and a crystal 222, all connected as shown.

Figure 4:
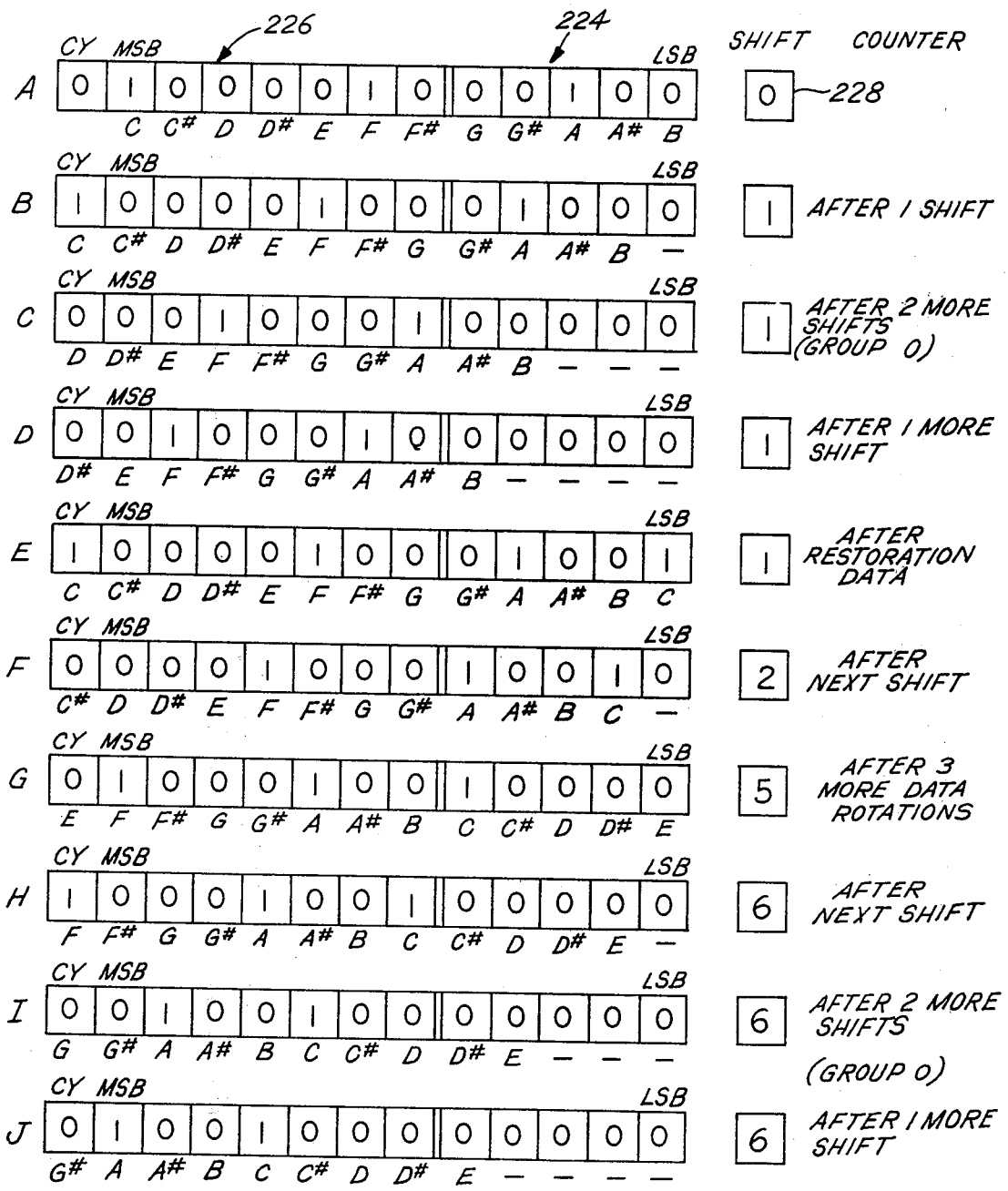
FIG. 4 is a block diagram illustrating the operation of certain registers in the microprocessor according to a second embodiment of the invention.

Referring to FIG. 4, microprocessor 170 also includes a four bit register 224 and an eight bit register 226 that comprises a carry bit CY, a most significant bit MSB and a least significant bit LSB. The purpose of a shift counter bit 228 is described later.

Referring to FIG. 1, a tempo clock 232 is provided in order to synchronize the system with the performer. The tempo clock may be speeded up or slowed down to suit the tempo at which the performer wishes to play. The tempo is established by rotating knob 234 which adjusts the rate at which tempo clock pulses are generated.

According to a preferred form of the present invention, a harmony selection system 86 cooperates with processing system 150 in order to recognize the harmony indicated by the depression of one or more keys of keyboard 88 by the performer.

Harmony selection system 86 comprises a harmony keyboard 88, including playing keys 90–126. The keys operate switch contacts 133 which correspond to switches 23 described in U.S. Pat. No. 3,745,225 (Hall—July 10, 1973, hereafter the "'225 Patent"). The switch contacts are connected through output conductors 134 (corresponding to conductors 24 of the '225 Patent) by a coupling network 135 of the same type described in that patent. Conductors 134 are connected to a conventional 12 bit latch 138 which can be addressed and read by processing system 150.

Each of the keys of keyboard 88 represents at least one note pitched in at least one octave. One such note and octave is printed on the keys in FIG. 1. For example, key 90 is used to produce at least a C note pitched in octave 1, and key 106 is used to produce at least an E note pitched in octave 2. As explained in the '225 Patent, coupling network 135 is arranged so that the playing of any key on keyboard 88 which corresponds to a C note results in a logical one signal on the C conductor of group 134, irrespective of the octave in which the C note is pitched. For example, the C conductor in group 134 will be raised to a logical one state if any or all of keys 90, 102, 114 or 126 are depressed by a performer. As a result, the input to latch 138 represents each of the notes produced by a performer's manipulation of keyboard 88, but does not indicate in which octave any of the notes are pitched.

By using the following techniques, the harmony desired by the performer can be recognized solely from his manipulation of keyboard 88. In order to recognize any chord type, the microprocessor attempts to match a representation of a playing key pattern with a corresponding chord type and root. In order to achieve this result, various playing key pattern representations are created. A performer may express a desire for a particular chord type based on a particular root by depressing the playing keys according to a number of different patterns. For example, the performer may express a desire for C minor harmony (i.e., chord type minor, root C) by actuating any one of the following key patterns:

1. C, D#
2. C, D#, G
3. C, D#, G, B
4. C, D#, B
5. D#, F, A#
6. C, D#, F, A#
7. C, D#, F, G (In this specification, the symbol # denotes a musical sharp.)

These key patterns can be used by the processor in several ways in order to derive a chord type signal indicating the chord type desired by the performer and a root signal indicating the root note of the harmony desired by the performer. According to a first embodiment of the invention, the playing key patterns can be converted to digital signals representing addresses of memory locations which store signals defining the chord type and root corresponding to the key pattern. If the memory locations store the chord type and root signals at addresses corresponding to the key pattern representations, the chord type and root signals may be obtained by merely reading their values from the memory. In such an embodiment, the stored representations of the key patterns are created by the circuitry forming the memory addressing logic. This technique results in rapid processing, but requires a considerable amount of memory.

Figure 3:
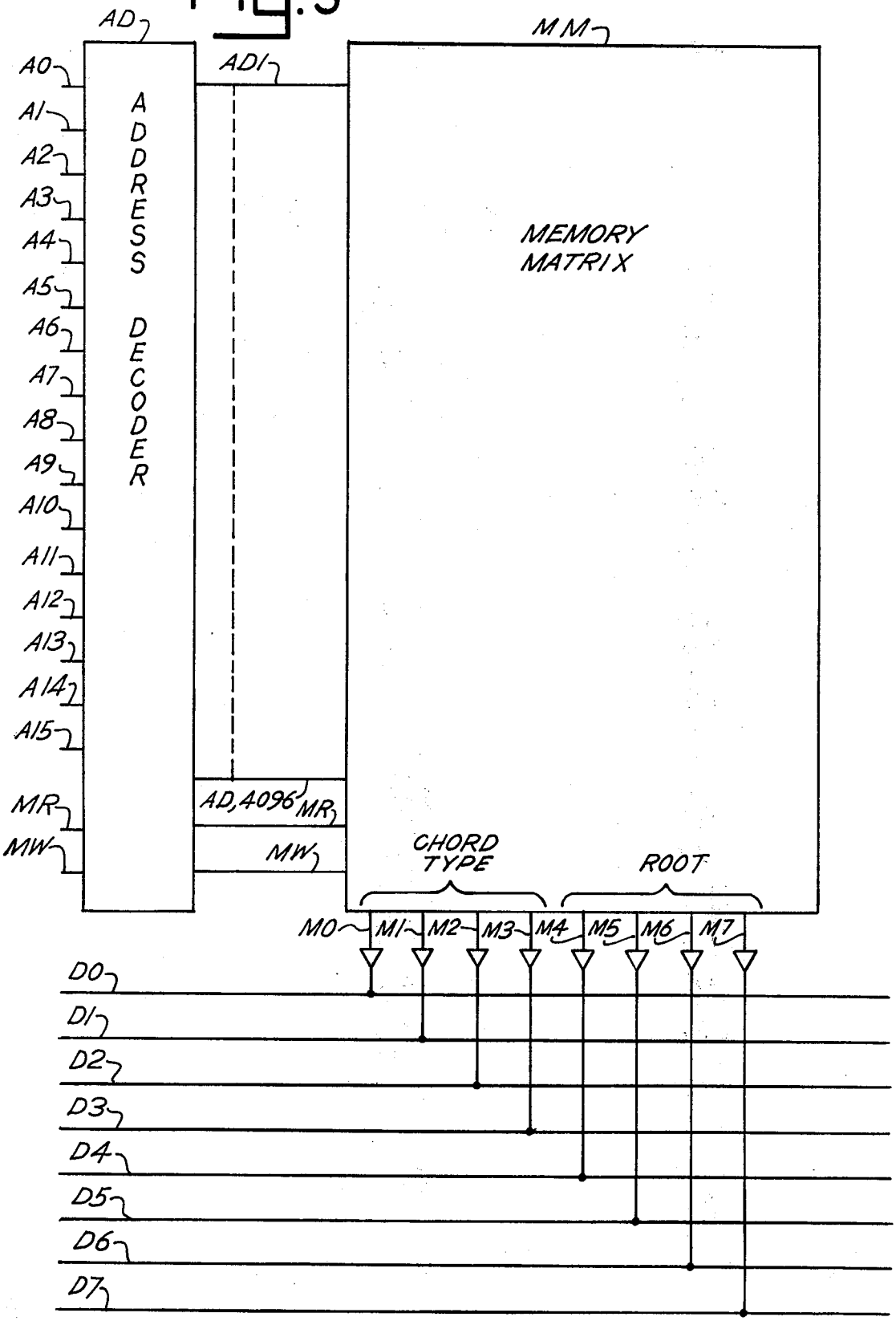
FIG. 3 is a block diagram illustrating the preferred form of memory used for one embodiment of the present invention.

Details of the first embodiment of the invention are more particularly described in connection with FIG. 3. As shown in FIG. 3, program ROM 162 includes an address decoder AD capable of addressing approximately 64K memory locations based on the bit configuration of address lines A0–A15. Decoder AD provides a means of reading data from a 64K memory matrix MM. Each of the memory locations in matrix MM stores an eight bit word. The first four bits of each word identify the chord type and the second four bits of each word identify the root corresponding to the key pattern resulting in the address of the location.

Since there are 12 possible notes playable by a performer, there are $2^{12}$ (i.e., 4,096) combinations of key patterns, and 4,096 memory locations must be used for the harmony recognition technique. Of course, many of the possible key patterns are invalid chords which do not correspond to musically valid harmony. In each of these memory locations, a word identifying an invalid chord will be stored. In memory locations corresponding to a harmonically valid key pattern, the chord type and root will be stored in the above described manner.

In order to operate the foregoing embodiment, the key pattern signal is stored in latch 138 and is read into the D and E registers of the Intel 8080 microprocessor 172 (FIG. 2). The twelve bit key pattern signal then is added to the starting address of the key pattern representation table of matrix MM. The completed address then is transmitted to decoder AD over address bus 155. Decoder AD addresses the location of matrix MM corresponding to the playing key pattern signal originally stored in latch 118. At the same time, the MR line is raised to a logical one state so that the corresponding chord type and root are read out of the matrix on conductors M0—M7 onto data bus 154. As a result, the chord type and root corresponding to the playing key pattern signal stored in latch 138 are available on the data bus for the synthesis of music or storage in another memory location for use in a manner described in the above-identified copending application.

Alternatively, an algorithm could be developed which would represent each of the key patterns desired to be recognized as a particular chord type. In this case, the algorithm would be stored as a general representation of the key patterns.

According to a second embodiment, the various key pattern representations can be stored in memory locations having addresses which indicate the chord type of the pattern. More specifically, for each chord type desired to be recognized, a plurality of chord pattern signals representing corresponding key patterns are stored in memory locations having addresses related to that chord type. After the chord pattern signals have been stored, harmony selection system 86 generates a playing key pattern signal identifying the pattern of the playing keys actuated by the performer and also identifying at least one note represented by at least one of the actuated playing keys. The playing key pattern signal then is used in an attempt to locate a corresponding stored chord pattern signal. The chord type signal and root signal are derived from the corresponding chord pattern signal.

The following is a detailed explanation of the second embodiment of harmony recognition. As previously explained, harmony selection system 86 produces on conductors 134, a multibit representation of the keys of keyboard 88 actuated by a performer. The note represented by an actuated key is represented on one of conductors 134 irrespective of the octave in which it occurs. For example, the C conductor of bus 134 is raised to a logical one state if any one of keys 90, 102, 114 or 126 representing C notes sounded in octaves 1, 2, 3 or 4 respectively, are actuated. Referring to FIGS. 1 and 4, the twelve bit representation of the playing key pattern is stored in latch 138 and is transferred by processor 170 into four bit register 224 and eight bit register 226 over bus 152. If microprocessor 170 has a data bus of twelve bits or larger, the playing key pattern signal stored in registers 224 and 226 can be directly compared to the chord pattern signals stored in ROM 164 until a match is found. However, most microprocessors currently available have only an eight bit data bus. It has been discovered that only eight of the bits of the playing key pattern signal need to be compared with the eight bit chord pattern signals stored in memory in order to locate the proper chord type. This is an important feature which enables harmony recognition to be carried out by an eight bit microprocessor with a minimum of memory. The manner in which this unique operation can be achieved by the microprocessor is described in more detail in FIG. 6.

Figure 6:
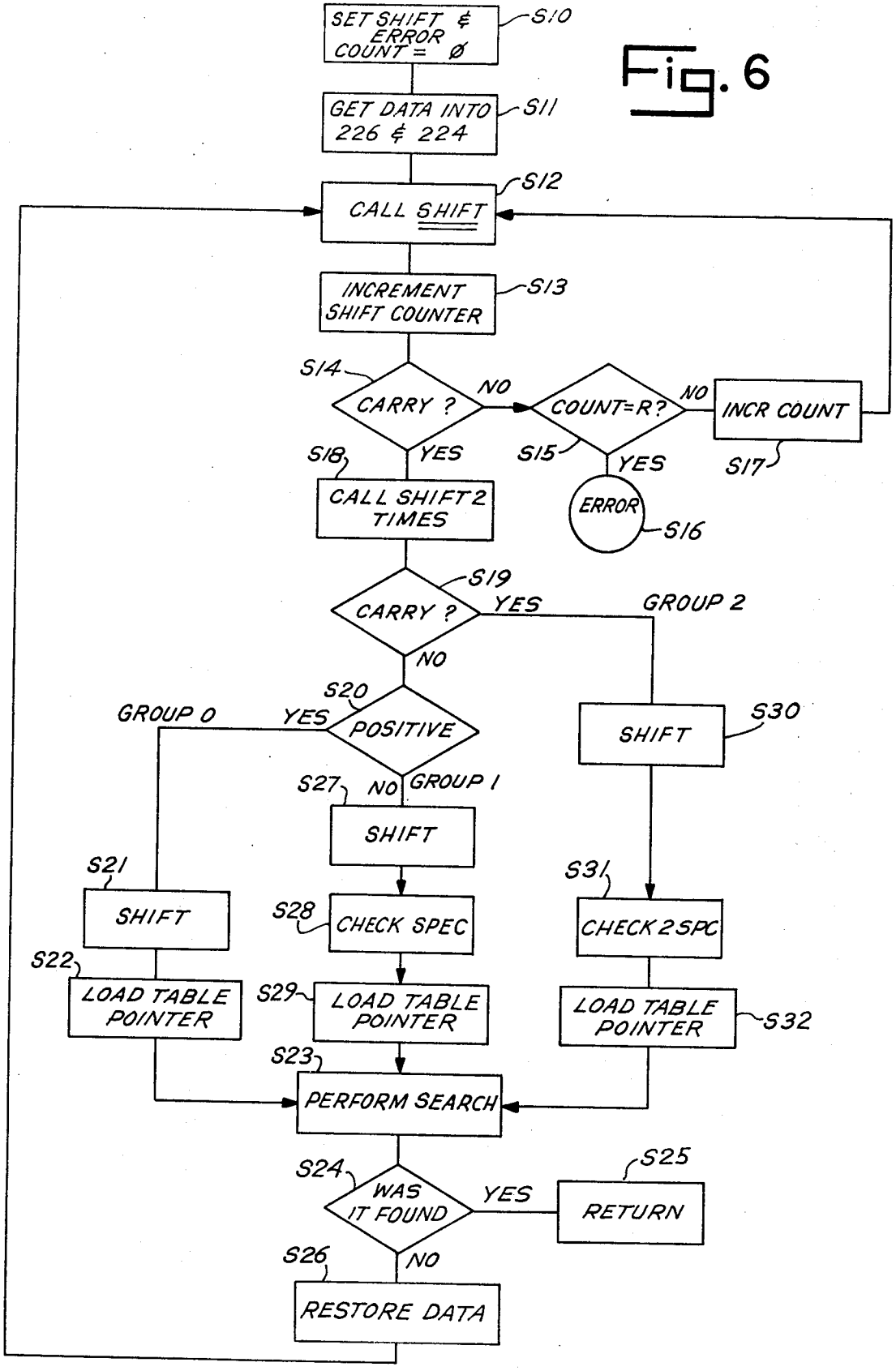
FIG. 6 is a flow chart illustrating the manner in which the processor determines the harmony desired by a performer according to the second embodiment of the invention.

FIG. 6 describes the harmony recognition routine of the program instructions stored in ROM 162. Briefly, the twelve bit playing key pattern signal stored in registers 224,226 can be reduced to an eight bit representation by judiciously testing certain bits and properly grouping others.

Referring to FIG. 6, in step S10, shift counter 228 and a software error counter are set equal to zero. The playing key pattern signal then is transferred into registers 224 and 226 in step S11. In step S12, the data in the registers is rotated one bit position to the left. Shift counter 228 is then incremented in step S13, and the carry (CY) bit is examined to determine whether it is a logical one or a logical zero in step S14.

If the CY bit is a one, steps S18–S20 (FIG. 6) are used to examine the next three bits of data in order to divide the playing key pattern signal into one of three groups (i.e., group zero, one or two). Assuming the bit representing the first note in the chord is in the CY position, the bit in the MSB position need not be considered since it would represent a note pitched one chromatic step from the note represented in the CY position. No valid chord has this combination of notes. For example, if the player had played keys 90, 94 and 97, the C, E and G lines of conductors 134 would be switched to a logical one state. Assuming the bit representing the C is shifted into the CY position, a logical one bit in the MSB position would indicate that the performer had also played a C♯. Since the C, C♯ combination would represent an invalid chord, the bit in the MSB position can be ignored. For this reason, the data can be rotated two more times in step S18 so that the bit representing a C♯ in the example is rotated beyond the CY position and ignored. This step then places the bits representing the keys corresponding to notes D and D♯ in the CY and MSB positions, respectively. If neither the D or D♯ notes were played by the performer, group zero is selected; if D♯ but not D was played by the performer, group one is selected; if D but not D♯ was played by the performer, group two is selected. The group selection process is carried out by steps S19 and S20. If, for example, group zero is selected, the data is rotated one more time in step S21, and a table pointer pointing to the group zero chord pattern signals in the memory is set up in step S22. A search of the group zero chord pattern signals in the memory is conducted in step S23. If a match is found between the remaining eight bits of the key pattern signal and the eight bits of the chord pattern signals stored in group 0, the harmony recognition routine returns to the main program through steps S24 and S25. If no match is found, the data located in registers 224 and 226 during step S14 is restored, and the process is repeated by returning to step S12.

In the event group one is selected, the register data is rotated in step S27, and the routine checks for any special chord pattern signals in step S28. The table pointer then is loaded in step S29, and the previously described search is performed on the group one chord pattern signals in step S23.

In the event group two is selected, the register data again is rotated in step S30, and the routine checks for special chord pattern signals in step S31. The table pointer again is loaded in step S32 and the same type of search is performed on the group two chord pattern signals in step S23.

Figure 5:
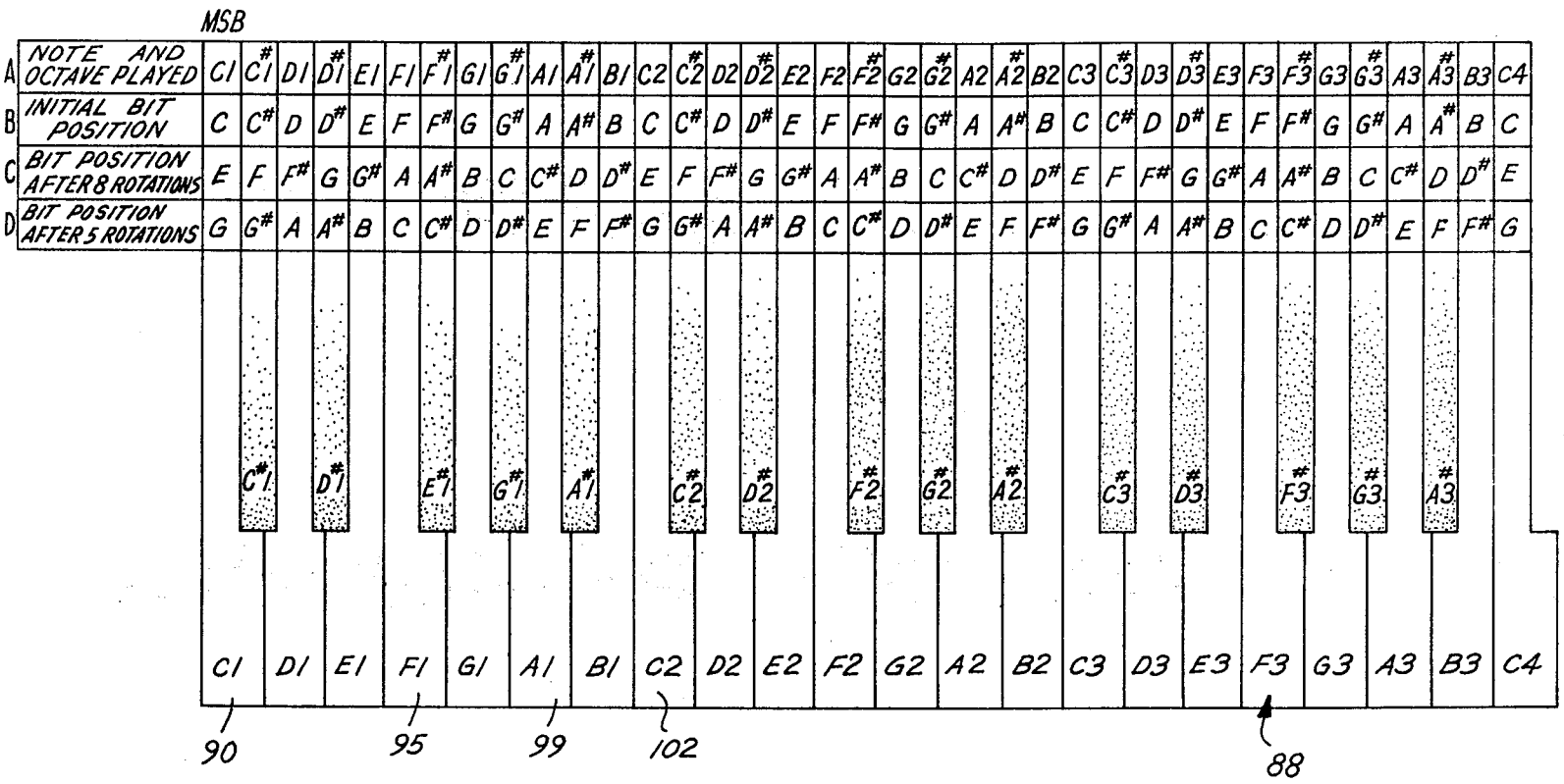
FIG. 5 is a chart illustrating the general operation of the registers shown in FIG. 4.

A better understanding of the unique techniques employed to determine the harmony desired by the performer may be obtained by the following example described in connection with FIGS. 4–6. Referring to FIG. 5, it will be assumed that the performer depresses keys 95, 99 and 102 representing notes F, A and C (thereby indicating that he desires a major chord having the root F). The depression of the keys will result in the playing key pattern signal shown in line A of FIG. 4. The note represented by each bit of the playing key signal is shown by the letters placed below registers 224 and 226 on each of lines A–J in FIG. 4. In accordance with step S12 (FIG. 6), the data is rotated one step to the left as shown in line B (FIG. 4), the shift counter 228 is incremented. After step S18 (FIG. 4), the data takes on the form shown in line C from which the routine determines that group zero should be searched. After step S21, the resulting data is shown in line D of FIG. 4. The table pointer is then loaded and the search performed, but no pattern in group zero corresponds to the pattern shown in line D.

As a result, step S24 is answered in the negative, and the data originally present at step S14 is restored, as shown in line E of FIG. 4. During the data restoration, the LSB bit is incremented to conform with the value of the carry bit CY, so that the data is accurately rotated during subsequent steps. The routine then returns to step S12 which shifts the data as shown in line F of FIG. 4. Since the carry bit, as well as the next three most significant bits, are zero, steps S15–S17 are followed for three additional rotation operations until the data is stored as shown in line G of FIG. 4. After the next shift is performed by step S12, the data is arranged as shown in line H of FIG. 4. Since a logical one is now shifted into the carry position, the routine proceeds through step S18 which rotates the data twice and results in the configuration shown in line I of FIG. 4. Steps S19 and S20 determine that group zero again should be searched, and this procedure is accomplished in steps S21, S22 and S23. Since the eight bit chord pattern illustrated in register 226 at line J is held in ROM 164, the routine detects a match, and returns to the main program through steps S24 and S25.

The chord pattern signal resulting in the match is stored at an address which corresponds to the chord type (major) of the played key pattern (i.e., FAC). The root note is derived from the value of the shift counter according to the following root table:

| Value of Counter 228 | Root Note |
|---|---|
| 1 | C |
| 2 | C# |
| 3 | D |
| 4 | D# |
| 5 | E |
| 6 | F |
| 7 | F# |
| 8 | G |
| 9 | G# |
| 10 | A |
| 11 | A# |
| 12 | B |

As shown in line J of FIG. 4, the shift counter value (6) at the time the match occurs corresponds to the root (F) of the chord played by the performer. The chord type signal and root signal are transferred by the processor to other memory locations for use in generating musical segments in a manner described later.

One unique feature of the harmony recognition routine is that the maximum number of searches of the memory is no greater than the number of keys that are depressed by the performer. This unique operation is achieved by steps S14–S17 which continue to shift data until the carry bit (corresponding to a depressed key) is found to be a logical one.

By dividing the chord pattern signals into three groups, only a small number of entries in the memory must be searched for any particular arrangement of data in register 226. These unique features enable the harmony desired by the performer to be selected from a standard keyboard with a minimum of memory and a minimum of processor time.

FIG. 5 illustrates how the data representing any combination of played keys is shifted through registers 224,226. Line A represents the notes and octaves resulting from the playing of the keys aligned with the entries in line A. Line B illustrates the notes initially represented by the bit positions in registers 224,226. Lines C and D illustrate the notes represented by the bit positions of registers 224,226 after 8 and 5 data rotations respectively. With the aid of FIG. 5, those skilled in the art can readily trace the rotation of data representing any combination of played keys.

A complete program listing capable of implementing the process described in FIG. 6 on an Intel 8080 microprocessor follows.

Those skilled in the art will recognize that the preferred embodiments described above can be altered and modified without departing from the true spirit and scope of the invention as defined in the appended claims.

What is claimed is:

1. A process for identifying the chord type and root represented by the actuation of one or more playing keys of a musical instrument keyboard capable of representing a group of chord types based on a group of roots, each of the playing keys corresponding to at least one note, said process employing a multiple-element register and multiple-location memory and comprising the steps of:

creating with respect to each chord type desired to be recognized a plurality of playing key pattern representations;

storing each playing key pattern representation in a memory location having an address representing the chord type corresponding to the playing key pattern representation;

generating a note signal corresponding to each note represented by an actuated key irrespective of the octave in which the note is pitched;

loading into the register a multi-bit data representation of the note signals;

rotating the data loaded into the register until one bit of the data corresponding to an actuated key is shifted into a predetermined element of the register;

storing a shift signal corresponding to the number of times the data is rotated;

comparing the data resulting from the rotation of the one bit into the predetermined element with the stored playing key pattern representations until a match is located;

deriving a chord type signal from the address of the playing key pattern representation resulting in the match; and deriving a root signal from the value of the shift signal, whereby the chord type signal and root signal are available for the synthesis of music.

2. Apparatus for identifying the chord type and root note represented by the actuation of one or more playing keys of a musical instrument keyboard capable of representing a group of different chord types based on a group of different roots, each of the playing keys corresponding to at least one note, said apparatus comprising:

means for creating with respect to each chord type desired to be recognized a plurality of playing key pattern representations, including digital memory means for storing each key pattern representation in a memory location having an address representing a chord type corresponding to the key pattern representation and addressing means for reading the key pattern representations out of the memory means;

means for generating a playing key pattern signal identifying the pattern of the one or more actuated playing keys, including means for generating a note signal corresponding to each note represented by an actuated playing key irrespective of the octave in which the note is pitched;

register means including multiple elements for storing a multi-bit data representation of the note signal;

means for rotating the data loaded into the register means until one bit of the data corresponding to an actuated key is shifted into a predetermined element of the register;

means for storing a shift signal corresponding to the number of times the data is rotated; and means for comparing the data resulting from the rotation of the one bit into the predetermined element with the stored key pattern representations until a match is located, for deriving a chord type signal from the address of the key pattern representation resulting in the match, and for deriving a root signal from the value of the shift signal, whereby the chord type signal and the root signal are available for the synthesis of music.

* * * * *